United States Patent [19]

Stenkvist et al.

[11] 4,149,024

[45] Apr. 10, 1979

[54] ARC FURNACE FOR REDUCING METAL OXIDES AND METHOD FOR OPERATING SUCH A FURNACE

[75] Inventors: Sven-Einar Stenkvist; Björn Widell, both of Vesteras, Sweden

[73] Assignee: ASEA Aktiebolag, Vesteras, Sweden

[21] Appl. No.: 776,868

[22] Filed: Mar. 11, 1977

Related U.S. Application Data

[63] Continuation-in-part of Ser. No. 594,733, Jul. 10, 1975.

[30] Foreign Application Priority Data

Jul. 23, 1974 [SE] Sweden ..... 7409556

[51] Int. Cl.[2] ..... H05B 7/20

[52] U.S. Cl. ..... 13/11

[58] Field of Search ..... 13/9, 11

[56] References Cited

U.S. PATENT DOCUMENTS 2,652,440 9/1953 Simmons ..... 13/11

3,883,677 5/1975 Hanas et al. ..... 13/9 X 3,885,082 5/1975 Hanas ..... 13/9 X

*Primary Examiner*—R. N. Envall, Jr.

*Attorney, Agent, or Firm*—Kenyon & Kenyon, Reilly, Carr & Chapin

[57] ABSTRACT

An arc furnace has an arcing electrode through which a feeding passage is formed for feeding metal oxide particles through an arc and to a melt in the furnace. The arc is powered by DC power with the electrode cathodic and the melt anodic. Carbon is fed as required to reduce the oxides. Electric currents passing through the melt and the arc to the electrode are capable of causing magnetic forces forcing the arc to acquire an angular deflection in a downward direction away from alignment with the electrode's outer periphery and towards the side wall of the furnace in one direction subst antially continuously, during continuous operation of the furnace. Means are provided for electromagnetically causing the arc to continuously rotate, with its deflection, around the electrode.

4 Claims, 6 Drawing Figures

ARC FURNACE FOR REDUCING METAL OXIDES AND METHOD FOR OPERATING SUCH A FURNACE

BACKGROUND OF THE INVENTION

This application is a continuation-in-part of U.S. Application Ser. No. 594,733, filed July 10, 1975.

The Simmons, U.S. Pat. No. 2,652,440, dated Sept. 15, 1953, discloses a DC arc furnace with a solid cathodic arcing electrode and the melt anodic. The DC power circuit is formed by an electrical lead contacting the melt directly below and in alignment with the arcing electrode so that the arc is formed vertically in alignment with the electrode. Electromagnets with pole pieces spaced around the furnace are used to cause the arc to angularly deflect from vertical alignment with the electrode and to rotate around the electrode.

The Robinson, U.S. Pat. No. 3,101,385, dated Aug. 20, 1963, discloses an AC arc furnace with a consumable arcing electrode having an internal axially extending feeding passage through which iron ore is fed to a melt in the furnace for reduction of the iron ore. The arc forms a downwardly spreading non-rotative annular cone around the falling ore fed through the bottom end of the arcing electrode via the latter's feeding passage, and the force of the arc keeps slag away from the arcing zone.

DeCovso et al, U.S. Pat. No. 3,736,358, dated May 29, 1973, discloses an AC arc furnace using a non-consumable arcing electrode of special construction having an annular electromagnet built within its lower end and causing a vertical arc formed with the melt in the furnace, to rotate. Iron ore is fed through the electrode for reduction in the furnace continuously and the furnace is tapped as required for slag removal and as required to remove the reduced iron during the continuous reduction. This patent states that the rotation of the vertical AC arc is not possible when using a consumable electrode.

The Valchev et al, U.S. Pat. No. 3,835,230, dated Sept. 10, 1974, discloses a DC arc furnace with a cathodic arcing electrode and an anodic melt powered via a horizontally offset or side melt contact electrode, producing what this patent calls "electromagnetic wind" causing the arc to curve from the tip of the arcing electrode away from the melt contact electrode. By using two or more such melt contact electrodes symmetrically around the side of the arcing electrode a vertical arc in alignment with the arcing electrode is supposed to be obtained.

It is known that in a commercially operating DC furnace, it is impractical to use a melt contact electrode positioned through the furnace hearth vertically below and in alignment with the arcing electrode. In a commercial furnace the melt contact electrode or electrodes are offset horizontally from alignment with the arcing electrode in side pockets as shown by the Valchev et al patent.

The present invention resulted from an attempt to develop a commercially operative arc furnace and method for continuously reducing metal oxides, particularly untreated or partially reduced iron ore particles. For simplicity and relaibility, it was decided that a graphite arcing electrode, possibly of the Soderberg type, or in other words, a consumable electrode, should be used; to reduce electrode consumption and to obtain a more uniform or smoother arc, the furnace should be powered by DC with the electrode operating cathodically; and that two or more symmetrically arranged side melt contact electrodes could be used to obtain a vertical arc. To feed the iron oxide particles to the arc, the consumable or graphite electrode should have an axial feeding passage.

Because of what was known before, it was believed that the furnace would operate with a smooth vertical arc into which the iron particles would be fed via the electrode passage, the necessary carbon being added with the iron oxide particles or possibly separately. Excepting for the use of DC and the consumable or graphite arcing electrode, the operation contemplated was somewhat as described by DeCorso et al in their patent. That is to say, that to satisfy commercial requirements, the furnace should operate continuously, continuously reducing the iron oxide and with slag and iron being tapped as required to maintain an appropriate iron and slag level.

However, it was found that this furnace would not, in fact, operate satisfactorily. Its academically known advantages did not materialize. With continuous operation, with the furnace conventionally constructed with the usual vessel having a hearth and side-wall upstanding from this hearth and provided with a cover, the side wall lining was subject to rapid localized wear. The expected rate of iron oxide reduction could not be obtained.

SUMMARY OF THE INVENTION

This invention resulted from the discovery that in spite of the symmetrical side-positioned melt contact electrodes, under continuous operating conditions the arc acquired an angular deflection. From the tip or bottom end of the arcing electrode the arc angled in a downward direction away from alignment with the arcing electrode and towards the furnace side wall lining. Under continuous furnace operation, the arc apparently maintained this angularity continuously, or at least for prolonged time periods, the resulting stationary arc flare being then in a direction towards a single portion of the furnace lining, thus resulting in rapid wear and ultimate possible destruction of the lining at that location. Iron oxide and carbon particles fed through the electrode would fall into the melt directly below the arcing electrode while the foot of the arc on the melt was offset to one side. Robinson describes in his patent that the force of his AC arc kept slag away from the arc zone so that material fed through his electrode passage would be directly reduced. Under the DC operation the foot of the arc displaced horizontally from beneath the bottom end of the electrode, preventing effective use of any such slag-displacing force.

Possibly under continuous DC operation of such an arc furnace, the traveling paths of the anodic currents through the melt, and possibly slag, are uncertain. Possibly it is just impossible currently to construct a commercial sized furnace that under DC operation and using side positioned melt contact electrodes or anodes, provides for uniform transmission of power of the arc required to maintain the arc in a vertical position beneath the tubular consumable arcing electrode. In any event, electromagnetic forces are created which cause the arc to be directed in one direction in the furnace and cause radiation against the furnace wall lining more in that direction than in other directions. The metal oxide material and the part of the melt hit by this material are heated from one direction only.

In the light of the foregoing the present invention evolved as comprising the use of electromagnets preferably on the outside of the furnace and around the arcing electrode with the magnet's pole pieces arranged so that by suitable electrical powering in a rotative manner, the arc, angularly deflected in the downward direction away from alignment with the arcing electrode, is caused to continuously rotate with that deflection around the electrode and thereby produce a rotating arc flare which is not destructively stationary but instead continuously sweeps around the furnace's side wall lining so as to distribute lining erosion. The deflected and rotating arc not only distributes the arc flare uniformly around the entire circumference of the furnace's side wall lining but, in addition, the foot of the arc travels continuously in a circle around the melt zone directly beneath the electrode and into which iron oxide or other metal oxides, and possibly carbon particles, are fed via the axially extending passage through the electrode. This keeps slag free from the melt surface to which the oxide is fed. The rotative speed of the arc depends, of course, on the frequency of the rotative current field used to power the electromagnets producing a rotating magnetic field in the furnace.

In practicing the present invention the electromagnets and their pole pieces may be arranged where conveinent; conventional furnace construction involves an outer supporting steel shell for the furnace's refractory lining, and this shell may be provided with openings in which the electromagnets may be installed. If made powerful enough the electromagnets may be installed in the roof of the furnace. The pole pieces should direct their magnetic fields transversely with respect to the arc, so the electromagnets should be positioned around the arcing electrode whether used above or below the arc level or at that level.

For practical reasons the electromagnets used to rotate the deflected arc, are preferably positioned spaced outwardly from the furnace lining's inside, where they are more easily protected from the furnace heat. As an academic concept, the electromagnets could be inside of the furnace lining, but would then require a cooled support holding them offset radially from the arcing electrode. This, in turn, would then require the use of a non-consumable electrode for mounting that support.

BRIEF DESCRIPTION OF THE DRAWINGS

The principles of the present invention are illustrated entirely schematically by the accompanying drawings, in which.

DETAILED DESCRIPTION OF THE INVENTION

Figure 1:
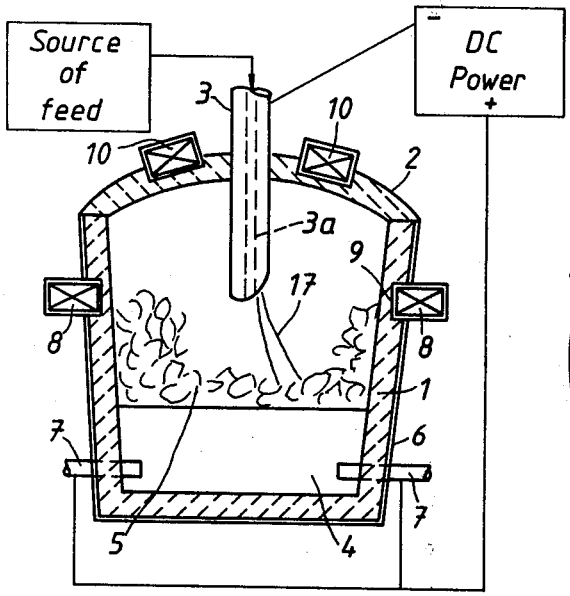
FIG. 1 is a vertical section showing an electric arc furnace incorporating those principles, the electromagnets being spaced outwardly from the furnace's inside.
Figure 2:
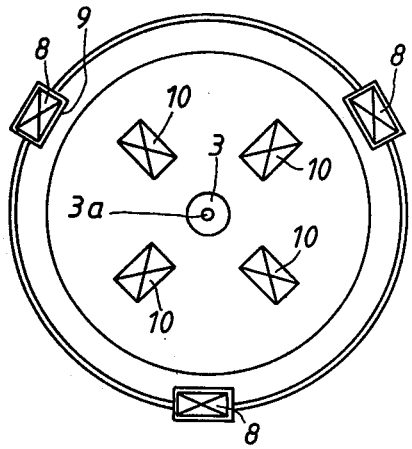
FIG. 2 is a top view of the furnace of FIG. 1.

Having reference to the above drawings, FIGS. 1 and 2 show the furnace vessel 1 with a furnace roof 2 and at least one hollow or tubular electrode 3 vertically extending through an electrode passage in the furnace roof. The hearth or bottom of the vessel 1 forms the furnace hearth which contains the iron melt 4, 5, indicating the solid part of the charge in the furnace, or in other words, slag or possibly coke or other carbonaceous material floating on the melt 4. At 6 is shown the steel furnace shell which encases the furnace lining. The electrode 3 is consumable or, in other words, is of the graphite or Soderberg type, and being tubular, it has the axial feeding passage shown at 3*a* for the feeding of the particles of iron ore, possibly prereduced to some extent by some prior treatment, and of small enough particle size to permit the necessary feeding. Diametrically opposed hearth electrodes 7 are shown with a DC power source anodically connected to these hearth electrodes or melt contacts, and cathodically connected to the consumable arcing electrode 3. Thus there is an electric circuit through the melt, arc and arcing electrode.

It is to be understood that as so far described prior art furnace design and construction is used. The tubular consumable electrode 3 can be fed as required by its consumption, in the usual manner of solid electrodes and for continuous operation may be fed in the form of interjointed sections with each section supplied as required. The ore can be continuously fed through the passage 3*a* in any suitable manner and it may be mixed with the carbonaceous material required for reduction, such as coke or coal in particulated form.

The steel shell or metallic casing 6 forms a gas-tight enclosure for the furnace lining and the hearth or melt contact electrodes 7 may be of the normal kind; although not illustrated, the normal kind involves the use of side pockets for the hearth and into which the melt extends, with the electrodes positioned in these side pockets in contact with the melt there.

The difference characterizing the present invention is that as illustrated, three electromagnets protected by casings 9 of non-magnetic metal such as stainless steel, are positioned in cutouts formed in the steel casing 6. These electromagnets are in the form of coils and they are either fed with AC at power frequency (50–60 Hz) when positioned above the melt level as illustrated by FIG. 1, or if positioned lower than illustrated, powered with low-frequency AC (10 Hz to 1 Hz). To provide the rotating magnetic field within the furnace vessel, these three coils may be fed with three-phase current, one phase for each coil. It should be noted, however, that if the three windings or coils 9 are fed with three-phase current, and if they are located symmetrically relative to the electrode 3, a symmetrical feeding of the coils would cause the desired magnetic fields to extinguish each other and the desired effect would, therefore, not be obtained.

According to Biot and Savart's law, on an electrical conductor with the current vector $\bar{I}$ in a magnetic field $\bar{B}$, a force $\bar{F}$ is obtained which is equal to $\bar{B}\times\bar{I}$. In this case $\bar{I}$ is the direct current in the arc and $\bar{B}$ the alternating field, and a condition for a resulting movement with the force $\bar{F}$ is that $\bar{B}$ is obtained as a rotating vector. This is achieved by using a two-phase or an unsymmetrical three-phase field.

To obtain the desired rotating field vector $\bar{B}$ with the three symmetrically arranged windings or coils, the AC phase direction for one of the coils is changed.

FIG. 1 also indicates the possibility of using two or four coils 10, these being shown installed in the furnace roof 2 radially offset from the electrode 3. In this case two-phase AC can be used with the coils or windings 10 symmetrically positioned about but offset from the electrode. In all cases the coils or windings should be protected against excessive heating by means which it has not been considered necessary to show.

Figure 6:
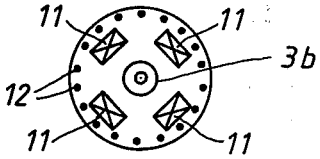
FIG. 6 illustrates the possible use of the electromagnets' inside of the furnace.

FIG. 6 is provided to indicate that the coils or windings may be placed inside of the furnace, as shown in the case of two-phase coils at 11, these being mounted offset from a non-consumable electrode 3*b* and carried by a suitable mounting provided with cooling ducts indicated at 12, the mounting being supported by the electrode.

Figure 3:
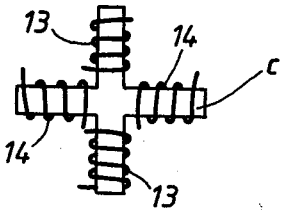
FIGS. 3, 4 and 5 suggest different electromagnetic arrangements which can be used to practice the present invention.
Figure 4:
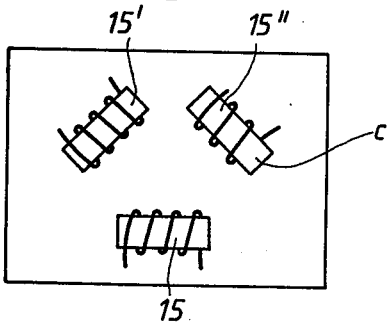

FIG. 3 shows in principle a two-phase coil arrangement mounted on a cross-type iron core C. Incidentally, iron cores are not shown in FIGS. 1 and 2 but would, of course, be used. The coils 13 and 14, respectively, are fed with two-phase current, either power frequency or low-frequency current. In FIG. 4 three-phase coils are shown, one phase for each coil, separate iron cores C being shown here to indicate that for practical application to the furnace each winding would usually have its own core in all cases. In this FIG. 4 one of the phases is reversed in relation to the symmetrical arrangement of the cores and coils, this being done by reversing one of the coil windings, as required to obtain the desired rotating magnetic field vector. The other two phases or coils 15' and 15'' are fed in the usual manner.

Figure 5:
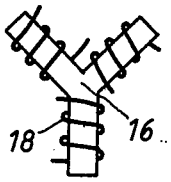

FIG. 5 shows another three-phase arrangement with a common iron core 16, one phase, for example phase 18, being reversely connected in relation to the symmetrical connection.

It would also be possible, of course, to arrange the coils underneath the furnace, and in that case frequencies of the order of magnitude of 1 Hz should be used, although this arrangement is not illustrated.

Referring back to FIG. 1, in operation the electrode 3 is continuously fed with iron oxide and the necessary carbon from the schematically illustrated source of feeding material and the DC power is applied by the indicated DC power source via the anodic melt electrodes 7 and the cathodic consumable arcing electrode 3. With the coils 8 and 10 unpowered, or in other words, operation in the conventional manner, prior art knowledge would indicate that an arc would be formed in vertical alignment with the vertical electrode 3 so that the furnace side wall would not be subjected to exaggerated localized erosion and ultimate destruction and with the feed via the electrode passage 3*a*, going directly into the arc and its foot or contact point on the melt 4. However, as previously indicated, under continuous furnace operation, these desirable effects are not obtained, the arc annularly deflecting downwardly and away from alignment with the electrode 3 as indicated at 17 in FIG. 1. When the electromagnets 8 or 10 ar suitably powered to provide the rotating magnetic field vector $\overline{B}$ cutting the arc 17, the angularly deflected arc 17 is forced to rotate as described. Then the arc describes a conical path blowing away the slag 5 as indicated with substantial exaggeration in FIG. 1. The material falling through the passageway 3*a* falls within the arc travel cone created by the magnetic rotating field.

With the angularly deflected arc rotating, possibly at high rpm, the expected advantages of the prior art furnace construction are obtained while at the same time the furnace side wall lining wear is uniformly distributed circumferentially.

What is claimed is:

1. A DC arc furnace comprising a vessel adapted to contain a melt in its lower portion and having an outer metal shell and an inner lining, a substantially vertical consumable arcing electrode having an axially extending internal feeding passage through which particles can be fed to said melt, said arcing electrode having a feeding tip positioned above said melt, at least one melt contact electrode for applying DC arcing power through said melt so as to form an arc between the melt and said tip, said melt contact electrode being horizontally offset from alignment with said arcing electrode so as to cause said arc to form as an angular arc which angles in a downward direction away from alignment with said arcing electrode and towards said lining, and electromagnets above the level of said melt in openings formed in said metal shell, said electromagnets partially extending through the shell and into said lining to positions spaced outwardly from the lining's inside, said electromagnets being arranged so that when supplied with AC they form a rotating magnetic field within said vessel forcing said angular arc to rotate around the axis of said arcing electrode rotatively with respect to said lining.

2. The furnace of claim 1 in which said vessel has a side wall and said electromagnets and said openings are in said side wall.

3. The furnace of claim 1 in which said vessel has a top cover wall and said electromagnets and openings are in said top cover wall.

4. The furnace of claim 1 in which said electromagnets are encased by a non-magnetic metal casing at least as to their portions inside of said shell and lining.

* * * * *